United States Patent [19]

Guidoni

[11] 3,939,845

[45] Feb. 24, 1976

[54] BRASSIERE WITH SLIDING TIES, AND ARRANGED IN A GENERAL "V" SHAPE, IN PARTICULAR FOR BATHING SUITS

[76] Inventor: Christian Guidoni, Immeuble "Le Plein Horizon," 62 Chemin du Bois, Rillieux La Pape Rhone, France

[22] Filed: June 14, 1974

[21] Appl. No.: 479,195

[30] Foreign Application Priority Data

June 15, 1973 France ..... 73.22579

[52] U.S. Cl. ..... 128/492; 2/67; 128/510

[51] Int. Cl.[2] ..... A41C 3/00

[58] Field of Search ..... 128/425, 456, 484, 485, 128/488, 489, 490, 491, 492, 493, 502, 506, 508, 510; 2/52, 67

[56] References Cited

UNITED STATES PATENTS

| | | | |
|---|---|---|---|
| 2,484,467 | 10/1949 | Schacht | 128/493 |
| 2,520,225 | 8/1950 | Scott-Elliot | 128/491 |
| 2,611,130 | 9/1952 | Engelman | 128/510 X |
| 2,673,982 | 4/1954 | Mosen et al. | 2/52 X |
| 3,306,299 | 2/1967 | Paramore | 128/510 X |

FOREIGN PATENTS OR APPLICATIONS

| | | | |
|---|---|---|---|
| 442,118 | 2/1936 | United Kingdom | 128/510 |
| 936,565 | 7/1948 | France | 128/510 |

*Primary Examiner*—Werner H. Schroeder
*Assistant Examiner*—Moshe I. Cohen
*Attorney, Agent, or Firm*—Irving M. Weiner

[57] ABSTRACT

A brassiere having two fabric pouches coupled to each other through the inner ends of their lower edges, and including ties of adjustable length, wherein two of the edges of each pouch are provided with hems in the form of tubes inside of which the ties may slide freely. At least one of the hem tubes is common to the two pouches, and the lengths of the ties are adjustable by the wearer to vary the height, the width, the depth, and the visible area of each pouch. The position of the brassiere with respect to the shoulders of the wearer is also adjustable through the lateral ties connected to each other behind the neck of the wearer.

8 Claims, 4 Drawing Figures

BRASSIERE WITH SLIDING TIES, AND ARRANGED IN A GENERAL "V" SHAPE, IN PARTICULAR FOR BATHING SUITS

The present invention relates to a brassiere, and particularly to a bathing suit, the brassiere of which is adjustable.

BACKGROUND OF THE INVENTION

It is known that one of the drawbacks in the brassieres of known types lies in the fact that they are constituted by pouches the depth and area of which are defined upon the making thereof. Now the users have figures which differ from each other, so that the number of sizes for a given model of bathing suit should be very great. A user, besides, cannot vary the area of her skin which she wants to expose to the sun.

An object of the present invention is to obviate such drawbacks and provide an adjustable brassiere, in particular for a bathing suit, wherein the ties slide inside the hems of the pouches, the size of the latter being adapted to be varied.

SUMMARY OF THE INVENTION

The present invention provides a brassiere having two fabric pouches coupled to each other through the inner ends of their lower edges, and ties of adjustable length. Two of the edges of each pouch are provided with hems which define tubes inside of which the ties of adjustable length may slide freely. At least one of the tubes is common to the two pouches. The lengths of the ties are adjustable by the wearer to vary the height, the width, and, consequently the depth and the visible area of each pouch. The position of the brassiere with respect to the shoulders of the wearer is also adjustable through predetermined ones of the ties connected to each other behind the neck of the wearer.

A brassiere according to the invention, in particular for a bathing suit, comprises two pouches made of textile yarn, each in the general shape of a pyramid with a triangular base, interconnected through the inner ends of their lower edges, and is characterized in that two of the edges of each pouch are provided with hems which define tubes inside of which ties of adjustable length slide freely, at least one of said tubes, as defined by the lower hems, being common to the two pouches, while the length of the ties is set by the user, the latter being able to vary the height, the width, and, therefore, the depth and the visible area of each pouch, while the position of the brassiere with respect to the shoulders is adjusted through the lateral ties, which are connected to each other behind the neck of the user.

According to another feature of the invention, the ties, which may be three in number, may be either longitudinally rigid textile, or elastic braids, or else textile-covered rubber threads.

According to another feature of the invention, the tubular hems of each pouch are converging towards the outer tip of the latter, while two ties extend out of said tip and have their ends connected on the back of the user to the ends of the ties extending freely out of the outer tip of the opposite pouch.

According to another feature of the invention, the ties form in each pouch a sliding "V" which allows adjusting the position of the brassiere on the breast, on the one hand, and the height and width of each pouch, on the other hand. Thus, a user is able to adapt a given model to her own figure, on the one hand and to the area of skin she wants to expose, for instance, to a sun bath, on the other hand.

According to another feature of the invention, the connection between the ties behind the neck and on the back of a user may be ensured merely by a knot tightened to the length required, whereby a quick adjustment of the size of the brassiere is made possible. On the other hand, the two ties extending out of each pouch tip under the armpits of the user may be tied together, near the free end thereof, by a knot, whereby adjusting the size and position of the brassiere is made easier.

It should be understood that the connections between the ties might be ensured by an adjustable system of a known type, such as, for instance, a sliding buckle mounted on one of the ties, and in which the other tie is clamped.

DETAILED DESCRIPTION

Figure 1:
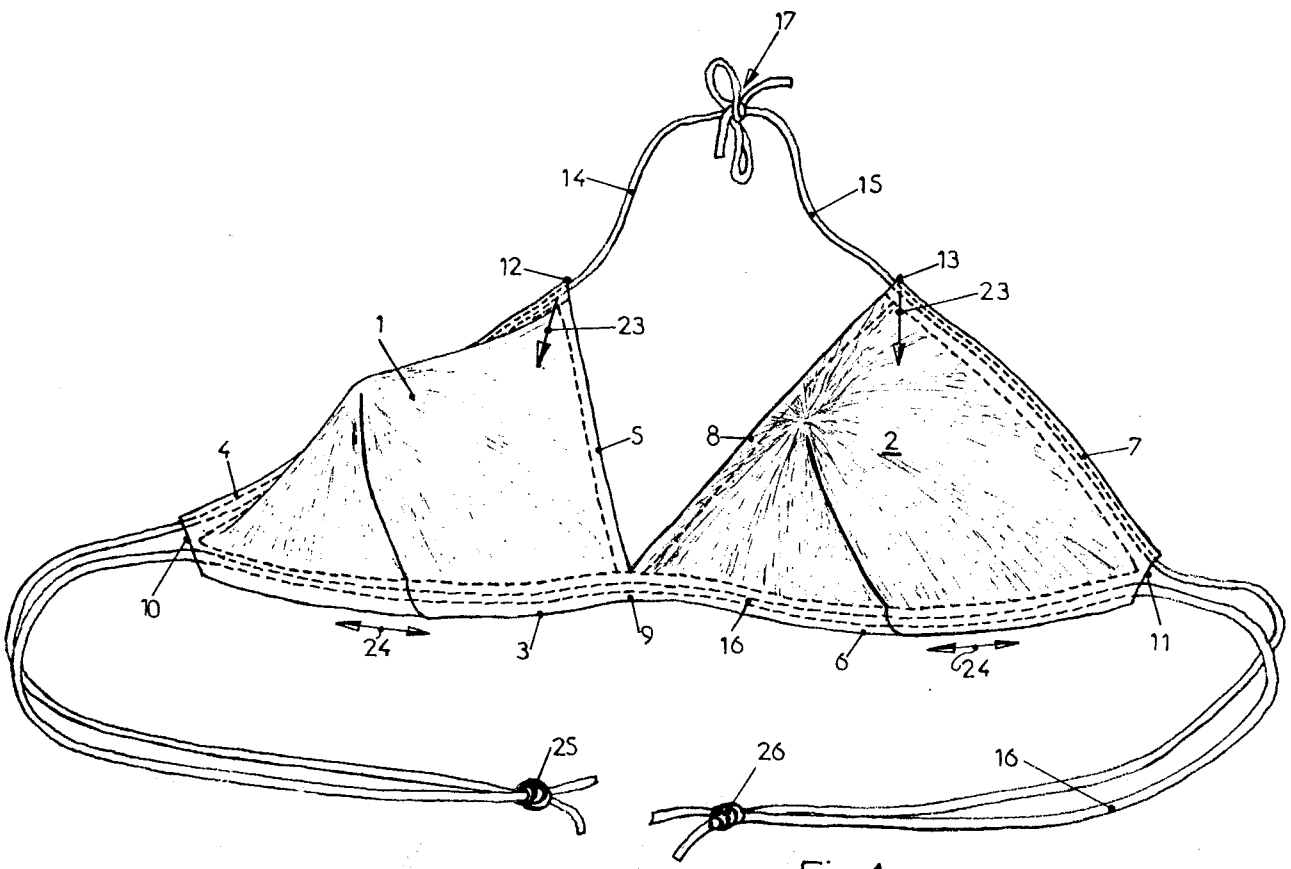
FIG. 1 is a perspective view of a brassiere according to the invention.

FIG. 1 shows a bathing suit brassiere including two fabric pouches 1 and 2. Each of said pouches is made of a single piece and is broadly shaped as a hollow pyramid, the lower edges of the faces of which are constituted by the hems of the piece of fabric. The lower edges 3 and 6, respectively, of the two pouches, are interconnected to define a common portion or "base". The hems on the inner side of each pouch are plain flat hems 5 and 8, respectively. The hems 4 and 7 on the outer sides of the pouches 1 and 2, respectively, are stitched in a manner such that they each define a flexible tube open throughout. On the other hand, the "base" constituted by the lower edges 3 and 6 is hemmed so as to form a single tube 9 open throughout from the tip 10 of the pouch 1 to the tip 11 of the pouch 2. The tubes 4, 7 and 9 are continuous throughout their lengths.

Figure 2:
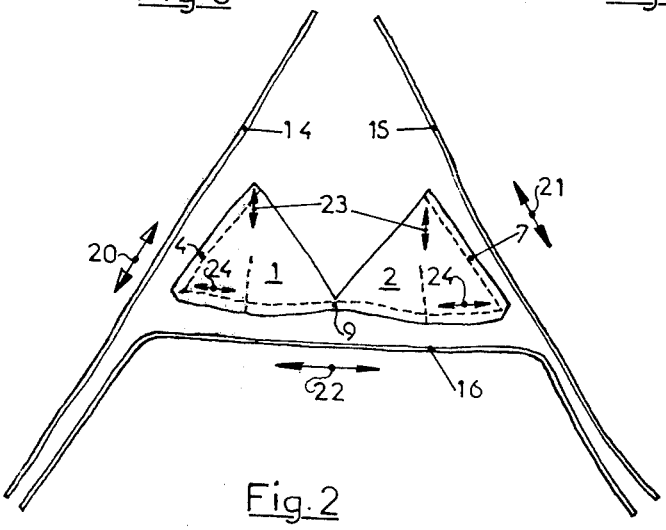
FIG. 2 is an exploded view of the elements constituting the brassiere of FIG. 1.

The brassiere also includes three ties or strings 14, 15 and 16, each of which is inserted in one of said tubular hems, wherein it can slide freely from one end of the tube to the other (doubles arrows 20, 21 and 22 in FIG. 2).

The brassiere of the invention is used as follows:

The strings 14, 15 and 16 are inserted into the tubular hems 4, 7 and 9, respectively. The strings 14 and 15 are tied together by a knot 17, adjustably tied at a distance from the ends of the strings. The user passes said knot 17 behind her neck, and then makes the tubes 4 and 7 of the pouches slide along the strings 14 and 15, respectively. On the other hand, the string 16 is inserted into the horizontal common tube 9, and its ends are tied together on the back of the user. The relative displacement of the pouches 1 and 2 with respect to the strings 14, 15 and 16 (in the direction of the double arrows 20, 21 and 22, respectively, FIG. 2) allows first positioning the fabric correctly regardless of whatever figure the user may have. Moreover, the distances between the pouch tips 10 and 12, 13 and 11, and 10 and 11 can be modified. As a matter of fact, since the strings are fully free inside the tubes defined by the hems 4, 7 and 9, the user may, for instance, bring the pouch tips 10 and 11 nearer to each other merely by making them slide over the string 16, whereby the fabric becomes puckered at the lower part of the brassiere. In the same way, the tips 10 and 12, on the one hand, and the tips 13 and 11, on the other hand, may be brought closer to each other, respectively. This adjustment is particularly advantageous in that:

the fabric does not interfere with the armpits of the user;

the user is able to modify at will the area of skin covered by each pouch, that is, increase or reduce the exposure to sun;

combining the adjustments in the directions 23 and 24 (FIGS. 1 and 2) allows modification of the depth of the pouches.

Figure 3:
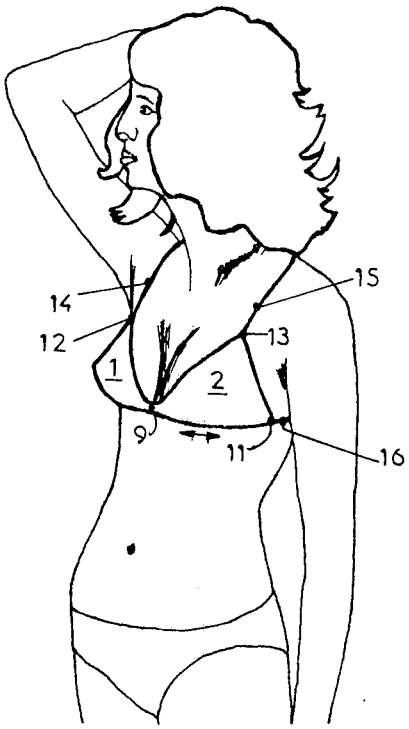
FIGS. 3 and 4 illustrate two different adjustments of said brassiere.
Figure 4:
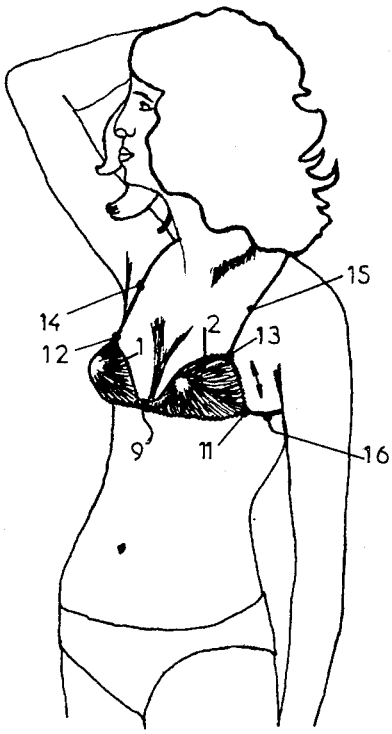

It will thus be seen that a brassiere of a given pattern can be readily adapted to various substantially different figures, while the same user is able to modify the appearance of her bathing suit as in FIGS. 3 and 4.

In FIG. 1, knots 25 and 26 are illustrated, the first of which ties the lower end of the string 14 to the corresponding end of the string 16, while the second knot 26 ties the lower end of the string 15 to the corresponding end of the string 16. Said knots 25 and 26, which are adapted to be untied, facilitate the connection between the ends of the strings on the back of a user. Of course, the two ends of the string 16, on the one hand, and the lower ends of the strings 14 and 15, on the other hand, may also be tied separately.

I claim:

1. A brassiere comprising, in combination:

two fabric pouches directly connected to each other only at the inner ends of their lower edges;

three ties of adjustable length;

two of the edges of each said pouch being provided with hems which define tubes inside of which said ties of adjustable length may slide freely;

at least one of said tubes being common to the two pouches;

one of said three ties is substantially horizontal and common to the two pouches and slides inside the lower hems of said pouches which define the common tube;

the length of said ties being adjustable by the wearer to vary the length, the width, and, consequently, the depth and the visible area of each said pouch; and the position of the brassiere with respect to the shoulders of said wearer also being adjusted through predetermined ones of said ties connected to each other behind the nech of the wearer.

2. A brassiere according to claim 1 wherein the adjusting ties are longitudinally rigid textile bands, such as laces.

3. A brassiere according to claim 1 wherein the adjusting ties are elastic braids.

4. A brassiere according to claim 1 wherein the adjusting ties are textile-covered rubber threads.

5. A brassiere according to claim 1, wherein said pouches are in the general shape of pyramids with triangular bases, and the tubular hems of each pouch converge towards the side tip of the pouch, from which tip two of said ties come out, the ends of which are connected on the back of the wearer with the ends of those ties which come freely out of the tip of the opposed pouch.

6. A brassiere according to claim 1 ties define in each pouch a sliding "V" which allows adjusting the location of the brassiere on the breast of the wearer, and the height and width of the pouches.

7. A brassiere according to claim 1 wherein the relative sliding of the fabric pouches with respect to the ties enables a same wearer to reduce or increase the area of skin exposed to the sun, such adjustment being facilitated by a removable knot which ties together at least two of said ties coming out of a same lateral pouch tip.

8. A brassiere according to claim 1 wherein connections between the ties are ensured by an adjustable device, such as a sliding buckle, mounted on one of the ties and in which another of said ties is clamped to allow adjusting the brassiere depending on the figure of the wearer and the area of skin covered.

* * * * *